US010329894B2

(12) United States Patent
Elsaadi et al.

(10) Patent No.: US 10,329,894 B2
(45) Date of Patent: Jun. 25, 2019

(54) BASE GAUGE AND MULTIPLE REMOTE SENSORS

(71) Applicant: Schlumberger Technology Corporation, Sugar Land, TX (US)

(72) Inventors: Abdul Halim Elsaadi, Singapore (SG); Adarshkumar Gouda, Singapore (SG); Teik Eng Ewe, Singapore (SG); Linghuan Li, Singapore (SG)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 60 days.

(21) Appl. No.: 15/194,545

(22) Filed: Jun. 27, 2016

(65) Prior Publication Data

US 2017/0370205 A1 Dec. 28, 2017

(51) Int. Cl.

*E21B 47/00* (2012.01)
*E21B 43/12* (2006.01)
*E21B 47/06* (2012.01)

(52) U.S. Cl.

CPC ..... *E21B 47/0007* (2013.01); *E21B 43/128* (2013.01); *E21B 47/0006* (2013.01); *E21B 47/06* (2013.01); *E21B 47/065* (2013.01)

(58) Field of Classification Search

CPC ..... E21B 43/1285; E21B 47/0006; E21B 47/0007; E21B 47/06; E21B 47/065

See application file for complete search history.

(56) References Cited

U.S. PATENT DOCUMENTS 6,167,965 B1 * 1/2001 Bearden ..... E21B 43/121 166/105.5
7,261,162 B2 * 8/2007 Deans ..... E21B 41/0007 166/250.01
7,268,670 B2 9/2007 Robertson
2003/0236626 A1 * 12/2003 Schroeder ..... G01K 11/32 702/6
2009/0140879 A1 * 6/2009 Kamata ..... E21B 47/12 340/853.2
2013/0272898 A1 10/2013 Toh et al.
2015/0136488 A1 * 5/2015 Hejleh ..... E21B 25/16 175/44
2015/0211526 A1 * 7/2015 Fastovets ..... F04D 13/10 417/44.1

FOREIGN PATENT DOCUMENTS

WO WO2008011889 A1 1/2008
WO WO2013132232 A1 9/2013

* cited by examiner

*Primary Examiner* — Francis C Gray

(57) ABSTRACT

A system for monitoring one or more downhole parameters. The system includes a downhole base gauge configured to receive power from a surface power drive and to communicate data with a surface computing device and a plurality of downhole remote sensors coupled to the base gauge in series and configured to generate data indicative of one or more observable parameters. The base gauge is further configured to query one of the remote sensors and, in response to such a query, the remote sensor is configured to transmit data indicative of the observable parameter associated with that sensor to the base gauge.

20 Claims, 6 Drawing Sheets

BASE GAUGE AND MULTIPLE REMOTE SENSORS

CROSS-REFERENCE TO RELATED APPLICATIONS

Not applicable.

STATEMENT REGARDING FEDERALLY SPONSORED RESEARCH OR DEVELOPMENT

Not applicable.

BACKGROUND

Some oil and gas production rigs employ an artificial lift electrical submersible pump (ESP) to increase pressure within a reservoir to thereby encourage oil to the surface. When the natural drive energy of the reservoir is not sufficient to push the oil to the surface, artificial lift is employed to recover more production. If an ESP fails during operation, the ESP must be removed from the pumping environment and replaced or repaired, either of which results in a significant cost to an operator.

In various applications, sensors or other detectors are used to monitor aspects of the pumping system, for example to detect or predict pumping system failure, or to provide surveillance engineers with a richer observable dataset upon which to make decisions regarding pumping system operation. In some cases, a base gauge may serve as a "hub" between surface monitoring equipment and one or more remote sensors positioned along the ESP string. However, the downhole environment is space constrained with respect to the ability to provide connectors to more than a small number of remote sensors. Further, the base gauge is often incapable of providing sufficient power for more than a small number of remote sensors.

SUMMARY

Embodiments of the present disclosure are directed to a system for monitoring one or more downhole parameters. The system includes a downhole base gauge configured to receive power from a surface power drive and to communicate data with a surface computing device and a plurality of downhole remote sensors coupled to the base gauge in series and configured to generate data indicative of one or more observable parameters. The base gauge is further configured to query one of the remote sensors and, in response to such a query, the remote sensor is configured to transmit data indicative of the observable parameter associated with that sensor to the base gauge.

Other embodiments of the present disclosure are directed to a method of monitoring one or more downhole parameters. The method includes providing downhole a base gauge configured to receive power from a surface power drive and to communicate data with a surface computing device and providing downhole a plurality of remote sensors coupled to the base gauge in series and configured to generate data indicative of one or more observable parameters. The method also includes querying one of the remote sensors and, in response to such a query, transmitting, by the remote sensor to the base gauge, data indicative of the observable parameter associated with that sensor.

This summary is provided to introduce a selection of concepts that are further described below in the detailed description. This summary is not intended to identify key or essential features of the claimed subject matter, nor is it intended to be used as an aid in limiting the scope of the claimed subject matter.

BRIEF DESCRIPTION OF THE DRAWINGS

Embodiments of the disclosure are described with reference to the following figures.

DETAILED DESCRIPTION

Figure 1A:
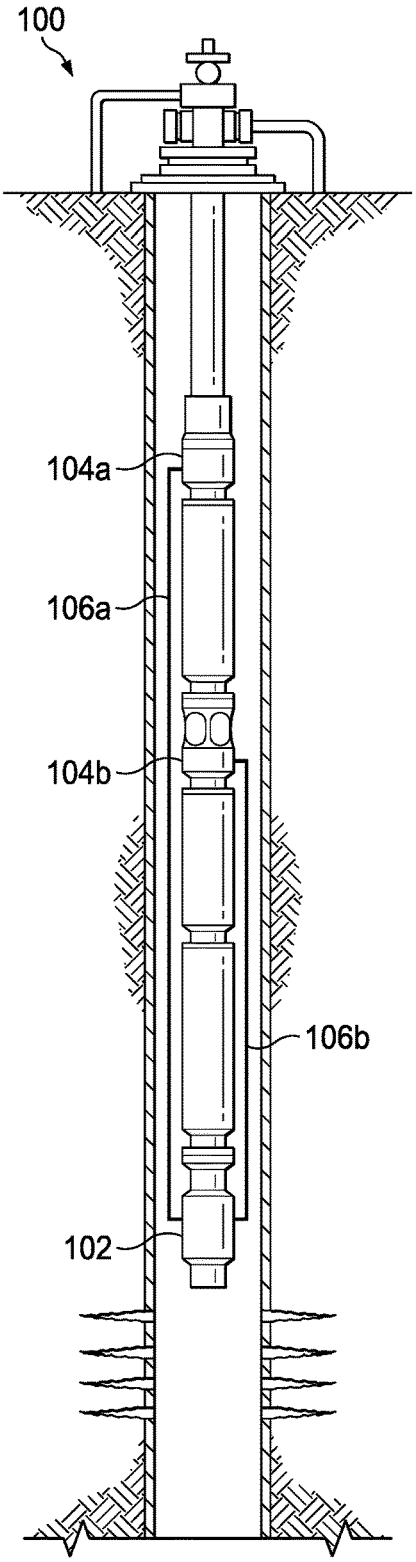
FIG. 1a (PRIOR ART)
FIG. 1*a* is an illustration of a prior art electric submersible pump (ESP) including a base gauge coupled to two remote sensors.

One or more embodiments of the present disclosure are described below. These embodiments are merely examples of the presently disclosed techniques. Additionally, in an effort to provide a concise description of these embodiments, all features of an actual implementation may not be described in the specification. It should be appreciated that in the development of any such implementation, as in any engineering or design project, numerous implementation-specific decisions are made to achieve the developers' specific goals, such as compliance with system-related and business-related constraints, which may vary from one implementation to another. Moreover, it should be appreciated that such development efforts might be complex and time consuming, but would nevertheless be a routine undertaking of design, fabrication, and manufacture for those of ordinary skill having the benefit of this disclosure.

When introducing elements of various embodiments of the present disclosure, the articles "a," "an," and "the" are intended to mean that there are one or more of the elements. The embodiments discussed below are intended to be examples that are illustrative in nature and should not be construed to mean that the specific embodiments described herein are necessarily preferential in nature. Additionally, it should be understood that references to "one embodiment" or "an embodiment" within the present disclosure are not to be interpreted as excluding the existence of additional embodiments that also incorporate the recited features. The drawing figures are not necessarily to scale. Certain features and components disclosed herein may be shown exaggerated in scale or in somewhat schematic form, and some details of conventional elements may not be shown in the interest of clarity and conciseness.

The terms "including" and "comprising" are used herein, including in the claims, in an open-ended fashion, and thus should be interpreted to mean "including, but not limited to . . . " Also, the term "couple" or "couples" is intended to mean either an indirect or direct connection. Thus, if a first component couples or is coupled to a second component, the connection between the components may be through a direct engagement of the two components, or through an indirect connection that is accomplished via other intermediate components, devices and/or connections. If the connection transfers electrical power or signals, the coupling may be through wires or other modes of transmission. In some of the figures, one or more components or aspects of a component may be not displayed or may not have reference numerals identifying the features or components that are identified elsewhere in order to improve clarity and conciseness of the figure.

Electric submersible pumps (ESPs) may be deployed for any of a variety of pumping purposes. For example, where a substance does not readily flow responsive to existing natural forces, an ESP may be implemented to artificially lift the substance. Commercially available ESPs (such as the REDA™ ESPs marketed by Schlumberger Limited, Houston, Tex.) may find use in applications that require, for example, pump rates in excess of 4,000 barrels per day and lift of 12,000 feet or more.

To improve ESP operations, an ESP may include one or more sensors (e.g., gauges) that measure any of a variety of phenomena (e.g., temperature, pressure, vibration, etc.). A commercially available sensor is the Phoenix MultiSensor™ marketed by Schlumberger Limited (Houston, Tex.), which monitors intake and discharge pressures; intake, motor and discharge temperatures; and vibration and current leakage. An ESP monitoring system may include a supervisory control and data acquisition system (SCADA). Commercially available surveillance systems include the LiftWatcher™ and the LiftWatcher™ surveillance systems marketed by Schlumberger Limited (Houston, Tex.), which provides for communication of data, for example, between a production team and well/field data (e.g., with or without SCADA installations). Such a system may issue instructions to, for example, start, stop or control ESP speed via an ESP controller.

Figure 1B:
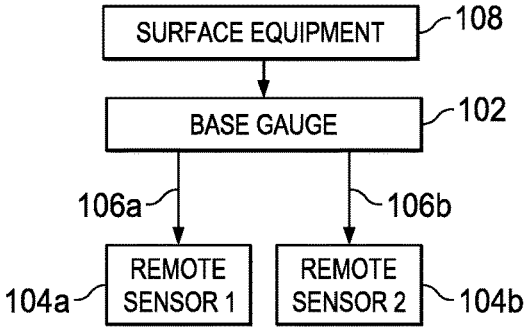
FIG. 1b (PRIOR ART)
FIG. 1*b* is an illustration of a block diagram of the prior art base gauge coupled to two remote sensors.

As explained above, sensors or other detectors are used to monitor aspects of the ESP, for example to detect or predict ESP failure, or to provide surveillance engineers with a richer observable dataset upon which to make decisions regarding ESP operation. FIG. 1*a* shows a prior art ESP string 100, including a base gauge 102 coupled to remote sensors 104*a*, 104*b* by way of control lines 106*a*, 106*b*, respectively. FIG. 1*b* shows a corresponding block diagram of the elements of FIG. 1*a*, in which surface equipment 150 is coupled to the base gauge 102, which in turn couples to each of the remote sensors 104*a*, 104*b* by way of dedicated control lines 106*a*, 106*b*. The surface equipment 150 may include a topside power drive such as a VSD to provide power to the base gauge 102 as well as various computing equipment to transmit to and receive from the base gauge 102 data, messages, and the like.

Requiring a separate control line 106 for each remote sensor 104 has several drawbacks. For example, additional control lines 106 consume additional space, which is limited to begin with. Additional control lines 106 in the downhole environment also increase complexity and may be more cumbersome to install, as well as introduce increased likelihood of failure. Further, in prior systems such as those shown in FIGS. 1*a* and 1*b*, the base gauge 102 supplies power to both remote sensors 104*a*, 104*b*. However, the total amount of power the base gauge 102 is able to supply is limited, and thus prior systems may be limited to one remote sensor 104, two remote sensors 104*a*, 104*b*, or an otherwise-limited number of remote sensors 104 due to constrains on the base gauge's 102 ability to supply power concurrently.

Embodiments of the present disclosure address these and other issues by providing a system and method for monitoring one or more downhole parameters in which a downhole base gauge is coupled to a plurality of downhole remote sensors in series. In particular, the base gauge receives power from a surface power drive such as a VSD and communicates data with a surface computing device. For example, the surface computing device may send commands to the base gauge to poll various sensors, while the base gauge may return data indicative of measurements of those sensors to the surface computing device. Since the base gauge is coupled to the remote sensors in series, the problems associated with requiring multiple control lines 106 is eliminated, since a single control line will be present between the base gauge and a proximate remote sensor, and between that remote sensor and another proximate remote sensor, and so on. Thus, unlike the prior art system 100, the base gauge in accordance with embodiments of the present disclosure only directly couples to one remote sensor, which then may couple to one other remote sensor, and so on.

In addition to eliminating the problem of dedicated control lines 106 for each remote sensor 104, embodiments of the present disclosure also permit a single base gauge to power any number of remote sensors. In particular, remote sensors according to embodiments of the present disclosure are configured to operate in either a standby mode or in an awake mode. In the standby mode, a remote sensor consumes a minimal amount of power, sufficient to receive and process a query or message from the base gauge, but insufficient to power its sensor to receive or acquire measurements and the like. In the awake mode, which the remote sensor enters after receiving a query from the base gauge, the remote sensor functions normally, and is able to acquire and transmit data indicative of an observable parameter to the base gauge. Once such a transmission is complete, the remote sensor reenters standby mode. As a result, and since the base gauge may only query one or a limited number of remote sensors at a time, a much larger number of remote sensors may be deployed along the ESP string without concern about the ability of the base gauge to power the various sensors, since polling may occur on an as-needed basis. Other embodiments and details thereof will be explained below, with reference to the accompanying figures.

Figure 2A:
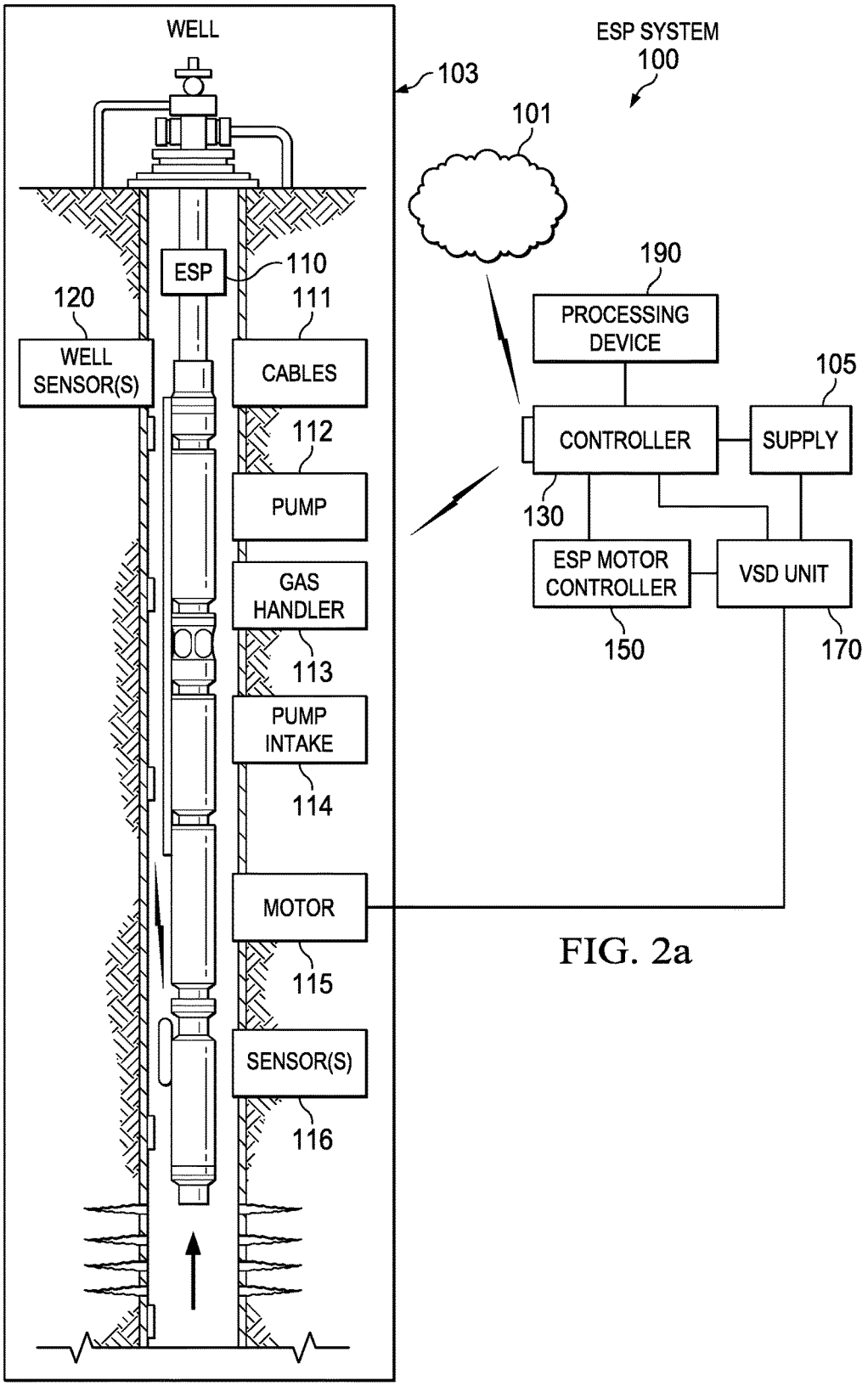
FIG. 2*a* is an illustration of an example of an ESP system deployed in a wellbore, according to an embodiment of the present disclosure.

Turning to FIG. 2*a*, an example of an ESP system 100 is shown. The ESP system 100 includes a network 101, a well 103 disposed in a geologic environment, a power supply 105, an ESP 110, a controller 130, a motor controller 150, and a VSD unit 170. The power supply 105 may receive power from a power grid, an onsite generator (e.g., a natural gas driven turbine), or other source. The power supply 105 may supply a voltage, for example, of about 4.16 kV.

The well 103 includes a wellhead that can include a choke (e.g., a choke valve). For example, the well 103 can include a choke valve to control various operations such as to reduce pressure of a fluid from high pressure in a closed wellbore to atmospheric pressure. Adjustable choke valves can include valves constructed to resist wear due to high velocity, solids-laden fluid flowing by restricting or sealing elements. A wellhead may include one or more sensors such as a temperature sensor, a pressure sensor, a solids sensor, and the like.

The ESP 110 includes cables 111, a pump 112, gas handling features 113, a pump intake 114, a motor 115 and one or more sensors 116 (e.g., temperature, pressure, current leakage, vibration, etc.). The well 103 may include one or more well sensors 120, for example, such as the commercially available OpticLine™ sensors or WellWatcher BriteBlue™ sensors marketed by Schlumberger Limited (Houston, Tex.). Such sensors are fiber-optic based and can provide for real time sensing of downhole conditions. Measurements of downhole conditions along the length of the well can provide for feedback, for example, to understand the operating mode or health of an ESP. Well sensors may extend thousands of feet into a well (e.g., 4,000 feet or more) and beyond a position of an ESP.

The controller 130 can include one or more interfaces, for example, for receipt, transmission or receipt and transmission of information with the motor controller 150, a VSD unit 170, the power supply 105 (e.g., a gas fueled turbine generator or a power company), the network 101, equipment in the well 103, equipment in another well, and the like. The controller 130 may also include features of an ESP motor controller and optionally supplant the ESP motor controller 150.

The motor controller 150 may be a commercially available motor controller such as the UniConn™ motor controller marketed by Schlumberger Limited (Houston, Tex.). The UniConn™ motor controller can connect to a SCADA system, the LiftWatcher™ surveillance system, etc. The UniConn™ motor controller can perform some control and data acquisition tasks for ESPs, surface pumps, or other monitored wells. The UniConn™ motor controller can interface with the Phoenix™ monitoring system, for example, to access pressure, temperature, and vibration data and various protection parameters as well as to provide direct current power to downhole sensors. The UniConn™ motor controller can interface with fixed speed drive (FSD) controllers or a VSD unit, for example, such as the VSD unit 170.

In accordance with various examples of the present disclosure, the controller 130 may include or be coupled to a processing device 190. Thus, the processing device 190 is able to receive data from ESP sensors 116 and/or well sensors 120. The controller 130 and/or the processing device 190 may also monitor surface electrical conditions (e.g., at the output of the drive) to gain knowledge of certain downhole parameters, such as downhole vibrations, which may propagate through changes in induced currents.

Figure 2B:
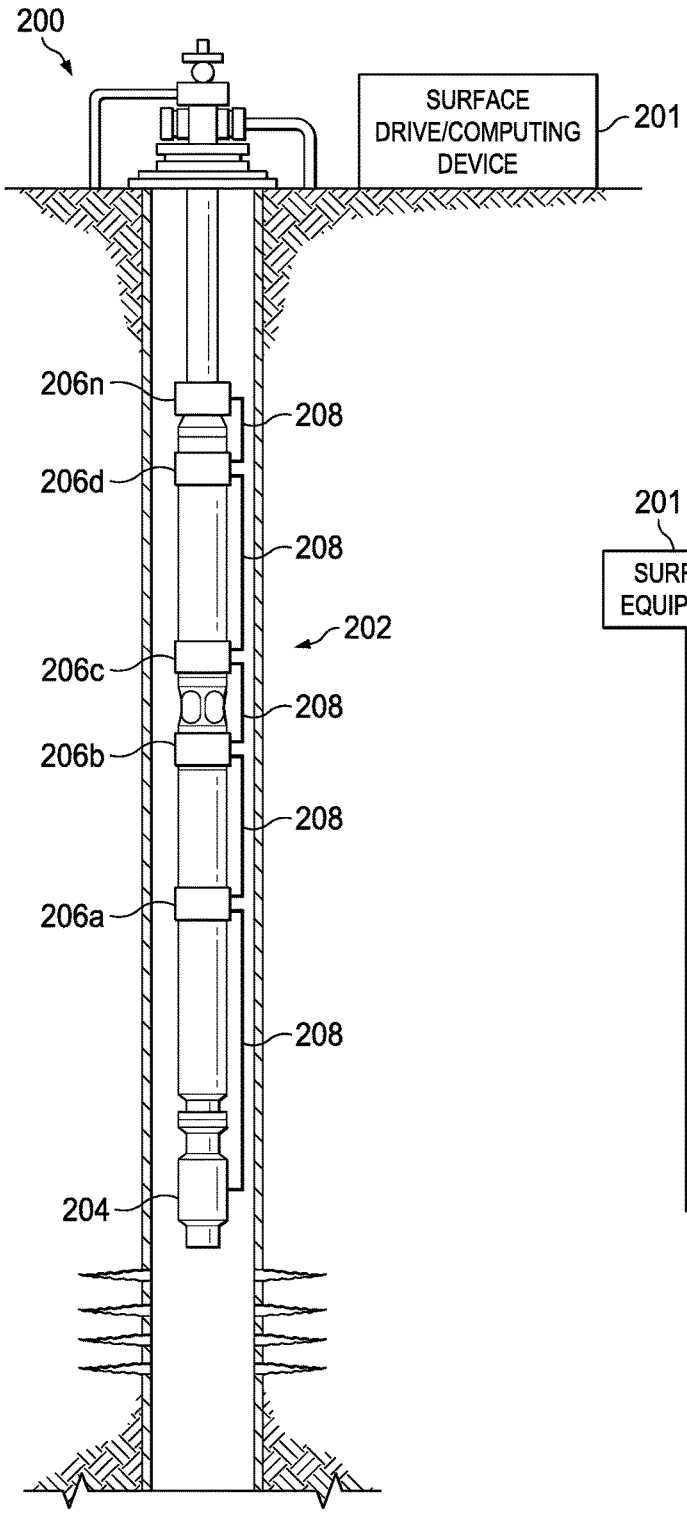
FIG. 2*b* is an illustration of an example of an ESP system deployed in a wellbore, where a base gauge is coupled to a plurality of remote sensors in series, according to an embodiment of the present disclosure.

FIG. 2*b* shows a system 200 in accordance with embodiments of the present disclosure, with particular focus on ESP string 202 and its base gauge 204 coupled to a plurality of remote sensors 206*a-n* in series. The remote sensors 206*a-n* may generate data indicative of any number of observable parameters, such as pressure, temperature, vibration, flow rate, proximity to the wellbore, and the like. As explained above, the base gauge 204 receives power and data from a surface power drive and computing device 201 and transmits data to the same. A single control line 208 directly couples the base gauge 204 to proximate remote sensor 206*a*, while a single control line 208 directly couples the proximate remote sensor 206*a* to another proximate remote sensor 206*b*, and so on. The control line 208 may comprise a coaxial cable having a single inner core. The control line 208 transmits power from the base gauge 204 to the remote sensors 206*a-n*, as well as carries messages transmitted between the base gauge 204 and the remote sensors 206*a-n*. In other words, the base gauge 204 both sends commands/queries to the remote sensors 206*a-n* by way of the control line 208 and the remote sensors 206*a-n* send messages to the base gauge 204 by way of the control line. By utilizing only a single control line between any two neighboring remote sensors 206*a-n* (and between one remote sensor 206*a* and the base gauge 204), space constraints are loosened, while the overall connection scheme is simplified.

In addition to eliminating the problem of dedicated control lines for each remote sensor as explained with respect to FIGS. 1*a* and 1*b*, the base gauge 204 is able to power any number of remote sensors 206*a-n*. In particular, remote sensors 206*a-n* are configured to operate in either a standby mode or in an awake mode. In the standby mode, a remote sensor 206 consumes a minimal amount of power, sufficient to receive and process a query or message from the base gauge 204, but insufficient to power its sensor to receive or acquire measurements and the like. In the awake mode, which the remote sensor 206 enters after receiving a query from the base gauge 204, the remote sensor 206 functions normally, and is able to acquire and transmit data indicative of an observable parameter to the base gauge 204. Once such a transmission is complete, the remote sensor 206 reenters standby mode. As a result, and since the base gauge 204 may only query one or a limited number of remote sensors 206*a-n* at a time, a much larger number of remote sensors 206*a-n* may be deployed along the ESP string 202 without concern about the ability of the base gauge 204 to power the various sensors 206*a-n*, since polling may occur on an as-needed basis.

Further, in certain embodiments, the base gauge 204 may be configured to address various issues that commonly arise from electrical imbalances that occur in the ESP system 100. Electrical imbalances arise as a result of mismatches between various components of the ESP system 100. For example, mismatches in resistance or inductance between phases of the motor 115 contribute to electrical imbalances. Electrical imbalance causes a normally-DC power supply that powers the base gauge 204 to become alternating, or AC. However, in the certain embodiments, the base gauge 204 is configured to utilize the imbalance condition, or the AC voltage, as a power supply for its internal circuitry and components. Thus, in these embodiments, the base gauge 204 is able to communicate with remote sensors 206*a-n* immune from issues that might otherwise arise in the presence of an imbalance condition.

Figure 2C:
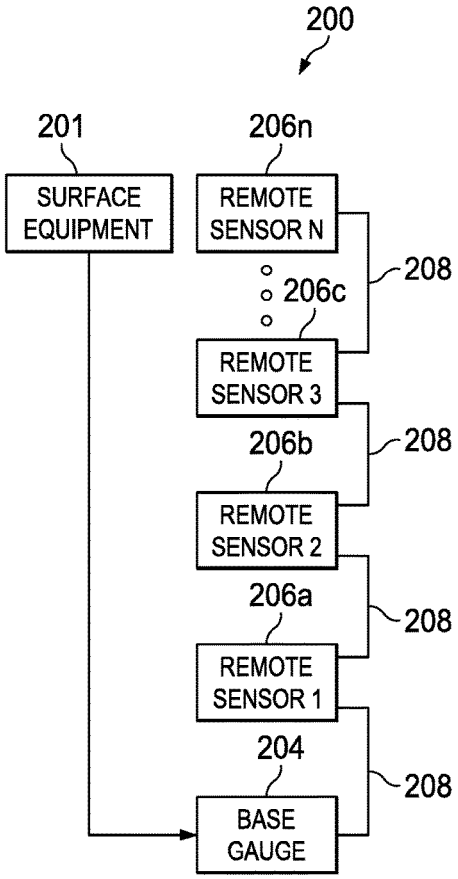
FIG. 2*c* is an illustration of a block diagram of the base gauge coupled to a plurality of remote sensors in series, according to an embodiment of the present disclosure.

FIG. 2*c* shows a block diagram of the system 200 to illustrate the single control line 208 that directly couples each pair of neighboring remote sensors 206*a-n* (and directly couples one remote sensor 206*a* to the base gauge 204).

Figure 3:
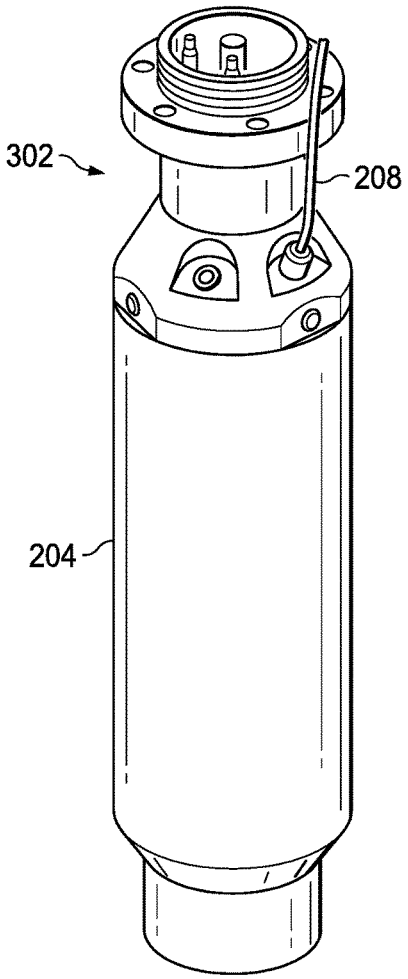
FIG. 3 is an illustration of various views of a base gauge and connector, according to an embodiment of the present disclosure.

FIG. 3 shows a perspective view of the base gauge 204 and in particular illustrates that only a single control line 208 from the base gauge 204 is needed to communicate with and supply power to a plurality of remote sensors. The base gauge 204 may house its internal electronics (e.g., for power provision and communications between the surface and the remote sensors) on a bracket, which is enclosed by an outer housing as shown. Various o-ring or other type seals (not shown) maintain a certain pressure inside the base gauge 204 during operation. A head 302 of the base gauge 204 is where the control line 208 terminates into the base gauge 204, and power and communication connections are provided between the termination of the control line and the internal electronics of the base gauge 204.

Figure 4B:
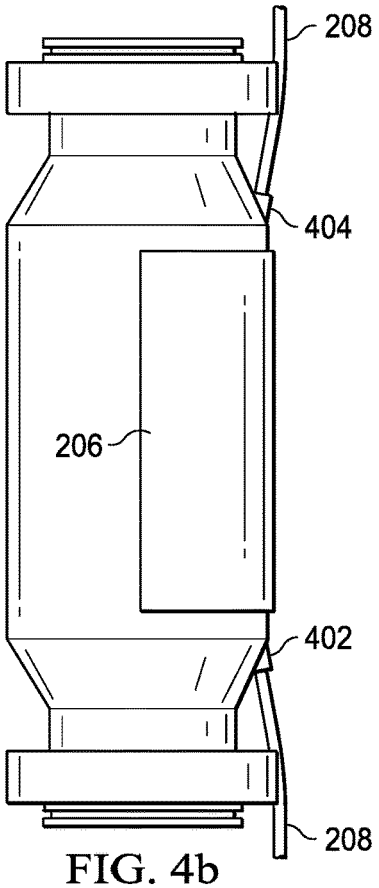
FIGS. 4*a* and 4*b* are illustrations of a remote sensor having a smallest effective outer diameter, according to an embodiment of the present disclosure.
Figure 4A:
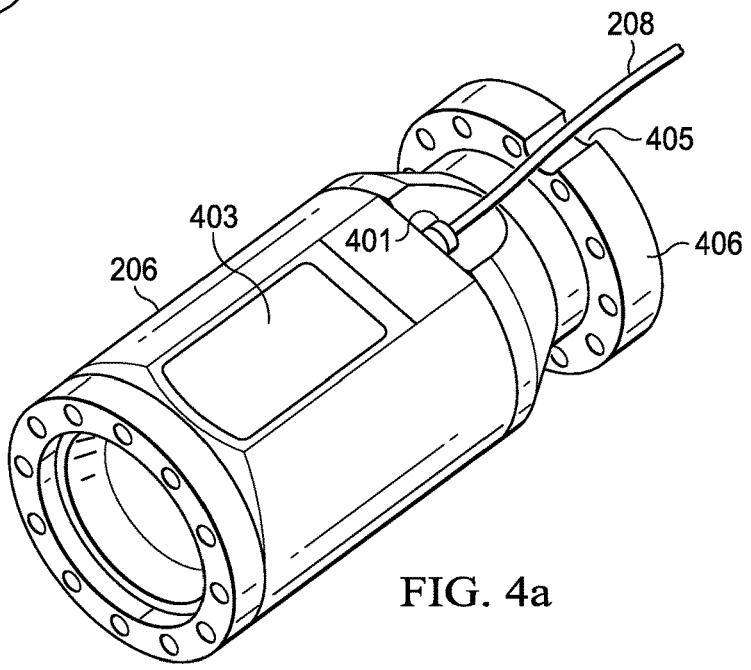

FIG. 4*a* shows a remote sensor 206 in further detail, including a termination 401 for the control line 208 and an exemplary welded electronics compartment 403 to protect the circuitry and power and communication electronics of the remote sensor 206. Similar to a base gauge 204, the remote sensor 206 houses electronics and transducer(s) to generate data indicative of observable parameters, although in a more compact arrangement. FIG. 4*b* shows another exemplary remote sensor 206 having a control line input 402 (e.g., to receive power and communications from the base gauge 204) and a control line output 404 (e.g., to transmit power and communications to another remote sensor 206). Of course, one of ordinary skill will appreciate that while these are referred to as "input" and "output," data in the form of indications of observable parameters will flow in the opposite direction. That is, data from a downstream remote sensor 206 (i.e., in the "up" direction in FIG. 4*b*) will be received at the output 404 and transmitted back to the base gauge 204 (or intermediary remote sensor(s) 206) by way of the input 402. Of importance is the fact that only a single control line 208 is required between sensors to couple a plurality of remote sensors 206 to the base gauge 204.

FIG. 4*a* also demonstrates that the base gauge 204 may include a flange 406 to couple to the ESP string, for example. The flange 406 includes a recess 405, which receives the control line 208 to ensure that the outer diameter of the base gauge 204, including the control line 208, is no greater than the outer diameter of the flange 406 itself, which is particularly useful when casing drift may be an issue. Similar flanges with recesses may be utilized on remote sensors as appropriate, to likewise ensure that their outer diameter does not exceed the outer diameter of the ESP string or the associated flanges, further reducing borehole clutter.

Figure 5A:
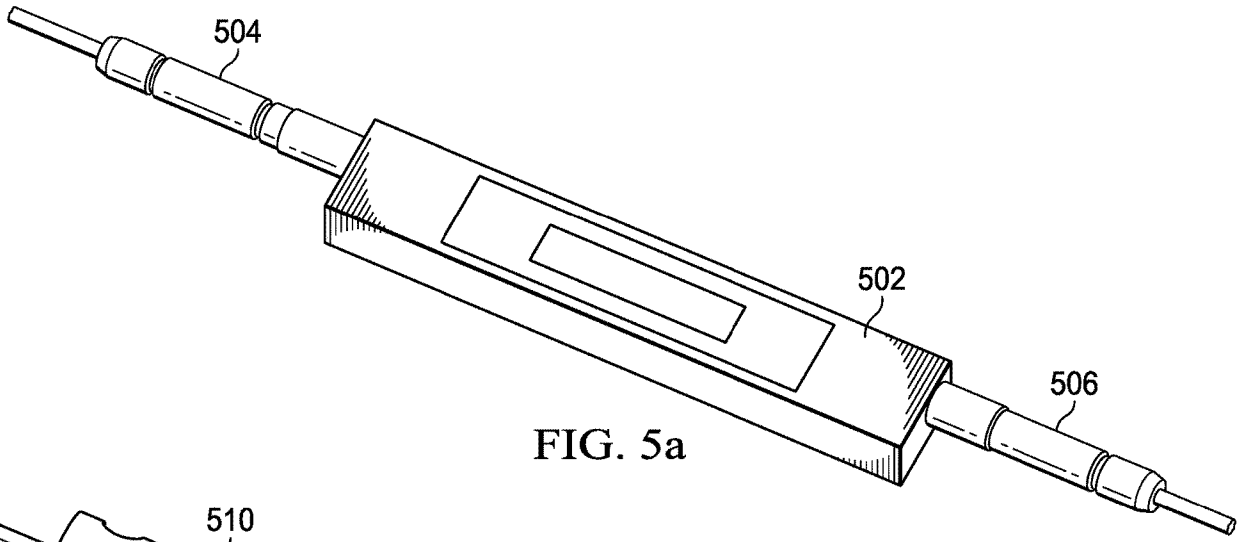
FIGS. 5*a* and 5*b* are illustrations of a clamp-mounted remote sensor, according to an embodiment of the present disclosure.
Figure 5B:
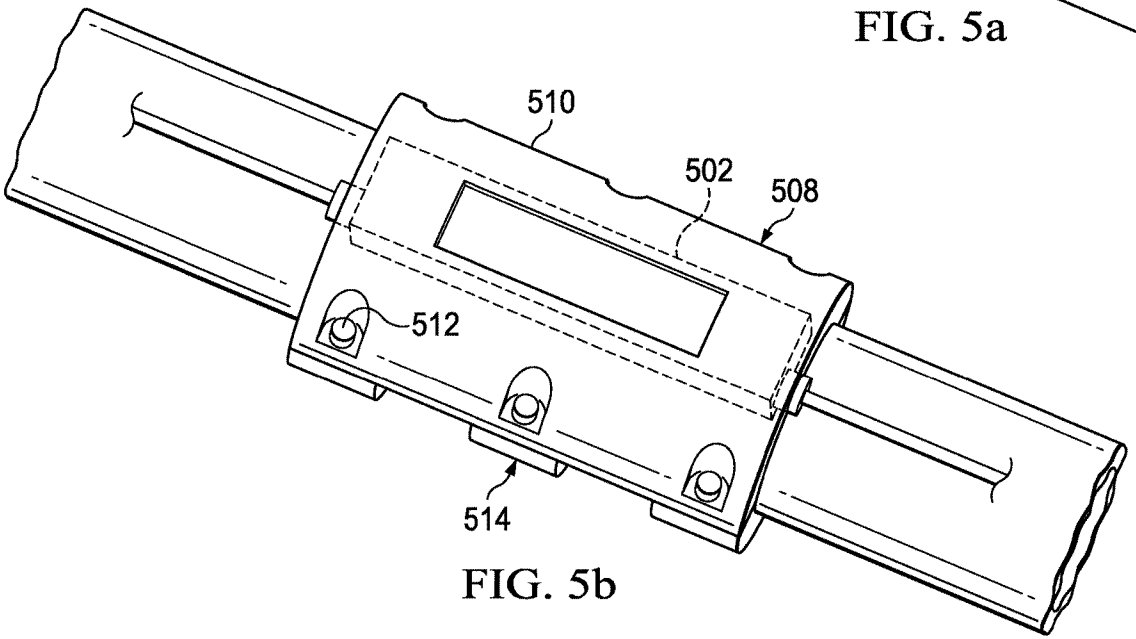

FIGS. 5*a* and 5*b* show examples of clamp-mounted remote sensors 502. In particular, in FIG. 5*a*, the remote sensor 502 houses various electronics and transducers or other measurement devices to generate data indicative of an observable parameter. Further, and as described above, the remote sensor 502 includes an input termination 504 and an output termination 506 for the transfer of power and data between the remote sensor 502 and its neighbors (i.e., either another remote sensor or a base gauge, as explained above). FIG. 5*b* depicts one embodiment 510 in which the remote sensor 502 is integrated into the clamp itself, or is formed as part of a clamp to clamp to a portion 508 of an ESP string, for example. FIG. 5*b* depicts another embodiment in which the remote sensor 502 is coupled to a clamp device 512, for example by one or more fasteners, which is then in turn clamped to a portion 514 of an ESP string. Regardless of the particular style of clamping, the clamp-mounted remote sensors 502 offer the flexibility to monitor parameters (e.g., vibration) at very specific locations along an ESP string. Further, in some cases, clamps of varying diameter may be employed to permit mounting to various sections of the ESP string having different outer diameters.

Figure 6:
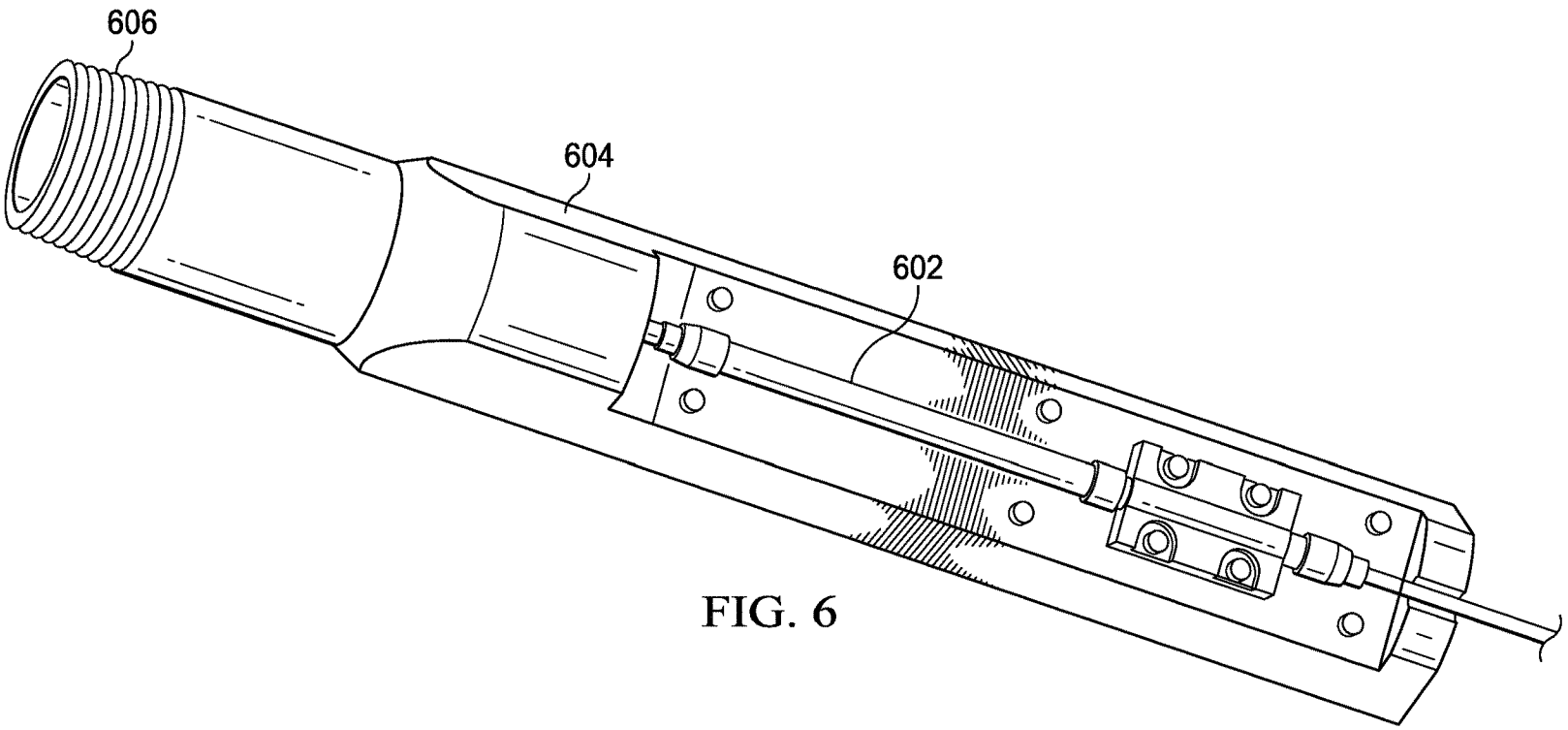
FIG. 6 is an illustration of a tubing-mounted remote sensor, according to an embodiment of the present disclosure.

FIG. 6 shows another example implementation of a remote sensor 602 in accordance with embodiments of the present disclosure. In particular, in FIG. 6, the remote sensor 602 is integrated to a portion of production tubing 604, for example to measure various tubing pressures (e.g., inlet and/or outlet pressures), temperatures, flow rates, vibration, and the like. The production tubing 604 also includes a coupling 606 to connect to other sections of tubing.

In addition to the foregoing, it should be appreciated that the scope of the present disclosure also extends to methods of use and/or installation of the various described systems for monitoring one or more downhole parameters. For example, certain methods may include providing a downhole base gauge configured to receive power from a surface power drive and to communicate data with a surface computing device and providing a plurality of downhole remote sensors coupled to the base gauge in series and configured to generate data indicative of one or more observable parameters. The method may also include querying one of the remote sensors and, in response to such a query, transmitting data from the remote sensor to the base gauge indicative of an observable parameter associated with that sensor.

Although only a few example embodiments have been described in detail above, those skilled in the art will readily appreciate that many modifications are possible in the example embodiments without materially departing from the electrical connector assembly. Features shown in individual embodiments referred to above may be used together in combinations other than those which have been shown and described specifically. Accordingly, all such modifications are intended to be included within the scope of this disclosure as defined in the following claims.

The embodiments described herein are examples only and are not limiting. Many variations and modifications of the systems, apparatus, and processes described herein are possible and are within the scope of the disclosure. Accordingly, the scope of protection is not limited to the embodiments described herein, but is only limited by the claims that follow, the scope of which shall include all equivalents of the subject matter of the claims.

What is claimed is:

1. A system for monitoring one or more downhole parameters, comprising:

a downhole base gauge configured to receive power from a surface power drive via a cable of a downhole electric motor and to communicate data with a surface computing device; and a plurality of downhole remote sensors coupled in series along a common line electrically coupled to the downhole base gauge wherein each of the downhole remote sensors is electrically powered by the downhole base gauge via the common line and individually configured to generate data indicative of at least one of one or more observable parameters;

wherein the base gauge is further configured to select one of the downhole remote sensors and transmit a query to the selected downhole remote sensor via the common line and wherein each of the downhole remote sensors is individually configured to awake from a standby low power mode upon receiving a query transmitted from the downhole base gauge via the common line, transmit data indicative of at least one of the one or more observable parameters via the common line to the downhole base gauge while awake and reenter the standby low power mode after transmission of the data.

2. The system of claim 1 wherein the downhole base gauge is configured to directly couple to only a selected one of the downhole remote sensors.

3. The system of claim 1 wherein the downhole base gauge is configured to query only a selected one of the downhole remote sensors at any given time.

4. The system of claim 1 wherein the downhole remote sensors, including associated connectors that couple them to a downhole string, comprise a maximum effective outer diameter that is not greater than a maximum outer diameter of the downhole string.

5. The system of claim 4 wherein each of the downhole remote sensors comprises a flange to couple to the downhole string, and wherein the flange comprises a recess configured to accept a connector of the common line that connects to another one of the downhole remote sensors or to the downhole base gauge.

6. The system of claim 1 wherein at least one of the downhole remote sensors is configured to clamp to an outer diameter of a portion of a downhole string.

7. The system of claim 6 wherein the at least one of the downhole remote sensors is clamped to the outer diameter of the portion of the downhole string and configured to generate data indicative of vibration of the portion of the downhole string.

8. The system of claim 1 wherein at least one of the downhole remote sensors is integrated to a portion of production tubing of a downhole string.

9. The system of claim 8 wherein the downhole remote sensor is configured to generate data indicative of at least one of tubing pressure, tubing temperature, tubing vibration, and tubing intake pressure.

10. A method of monitoring one or more downhole parameters, comprising:

providing downhole, a base gauge configured to receive power from a surface power drive via a cable of a downhole electric motor and to communicate data with a surface computing device;

providing downhole, a plurality of remote sensors electrically coupled to the base gauge in series along a common line and individually configured to generate data indicative of at least one of one or more observable parameters;

transmitting a query by the base gauge and via the common line, to one of the remote sensors;

receiving, by the one of the remote sensors, the query wherein receipt of the query causes the one of the remote sensor to awake from a standby low power mode;

transmitting data indicative of at least one of the one or more observable parameters from the one of the remote sensors via the common line to the base gauge while awake; and for the one of the remote sensors, reentering the standby low power mode after transmitting the data.

11. The method of claim 10 further comprising selecting a single one of the remote sensors and directly coupling the base gauge to only the selected single remote sensor.

12. The method of claim 10 further comprising querying, by the base gauge, only a single one of the remote sensors at any given time.

13. The method of claim 10 wherein the remote sensors, including associated connectors that couple them to a downhole string, comprise an effective maximum outer diameter that is not greater than a maximum outer diameter of the downhole string.

14. The method of claim 13 wherein each of the remote sensors comprises a flange to couple to the downhole string, and wherein the flange comprises a recess configured to accept a connector of the common line that connects to another one of the remote sensors or to the base gauge.

15. The method of claim 10 wherein at least one of the remote sensors is configured to clamp to an outer diameter of a portion of a downhole string.

16. The method of claim 15 further comprising generating, by the at least one of the remote sensors clamped to the outer diameter of the portion of the downhole string, data indicative of vibration of the portion of the downhole string.

17. The method of claim 10 further comprising integrating at least one of the remote sensors to a portion of production tubing of a downhole string.

18. The method of claim 17 further comprising generating, by the at least one of the remote sensors, data indicative of at least one of tubing pressure, tubing temperature, tubing vibration, and tubing intake pressure.

19. The system of claim 1 wherein the common line comprises a plurality of wires.

20. The method of claim 10 wherein the common line comprises a plurality of wires.

* * * * *